US005884615A

United States Patent [19]

Casas Salva

[11] Patent Number: 5,884,615

[45] Date of Patent: Mar. 23, 1999

[54] DUAL MODE AMMUNITION LOADING AIR OR GAS-POWERED GUN

[75] Inventor: Francisco Casas Salva, Barcelona, Spain

[73] Assignee: Industrias El Gamo, S.A., Barcelona, Spain

[21] Appl. No.: 974,279

[22] Filed: Nov. 19, 1997

[51] Int. Cl.[6] ..... F41B 11/00

[52] U.S. Cl. ..... 124/71; 124/72; 124/74; 124/31; 124/37; 124/51.1; 124/52

[58] Field of Search ..... 124/71, 72, 73, 124/74, 75, 31, 37, 41.1, 51.1, 52

[56] References Cited

U.S. PATENT DOCUMENTS

| | | | |
|---|---|---|---|
| 4,191,158 | 3/1980 | Curran | 124/76 |
| 5,509,399 | 4/1996 | Poor | 124/76 |
| 5,666,937 | 9/1997 | Mendoza-Orozco | 124/67 |

*Primary Examiner*—J. Woodrow Eldred

*Attorney, Agent, or Firm*—Graybeal Jackson Haley, LLP

[57] ABSTRACT

A dual mode ammunition loading air or gas-powered gun. The gun is conceived for shooting manually loaded small bullets shot by shot, or for alternatively acting as a repeating weapon for spherical ammunition (2) fed from a loader (4), dispensed one by one into a pocket (9) of an ammunition shifting body (8) mounted in a sliding arrangement, perpendicular to the barrel (3), so as to shift the ammunition up to a position in coalignment with the barrel (3) and with an air/gas delivery hole (17), of a compression chamber. The trigger (18) of the gun, is pin-jointed with a drawing member (19) spring-loaded at one (19*a*) of its ends and whose other end (19*b*) is connected to the striking hammer (21) for its cocking and ulterior release. The shifting body (8) is linked with the trigger through an assoicated lever (23) whose first end (23*a*) is rotatably pin-jointed with said trigger (18) and whose other end (23*b*) is hinged connected with said shifting body (8). A filter block (41) made of a porous material is located between the outlet of a reservoir (29) and the chamber (39).

6 Claims, 3 Drawing Sheets

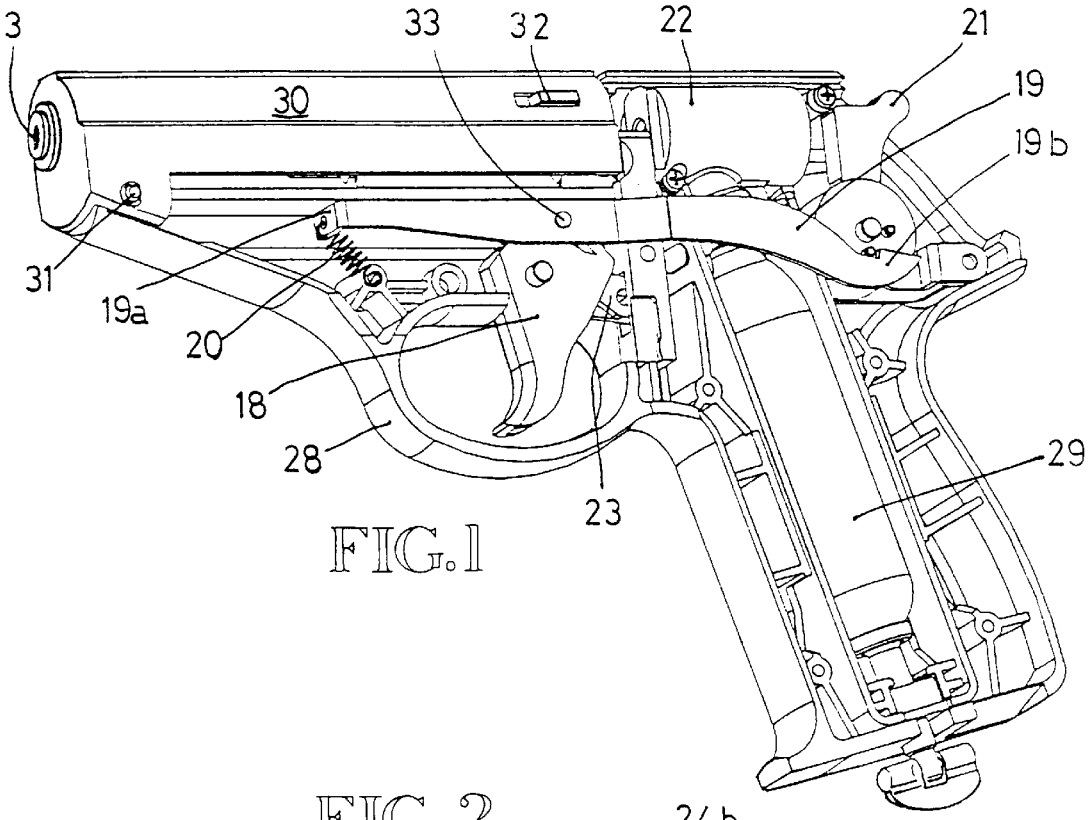
FIG. 1
FIG. 2
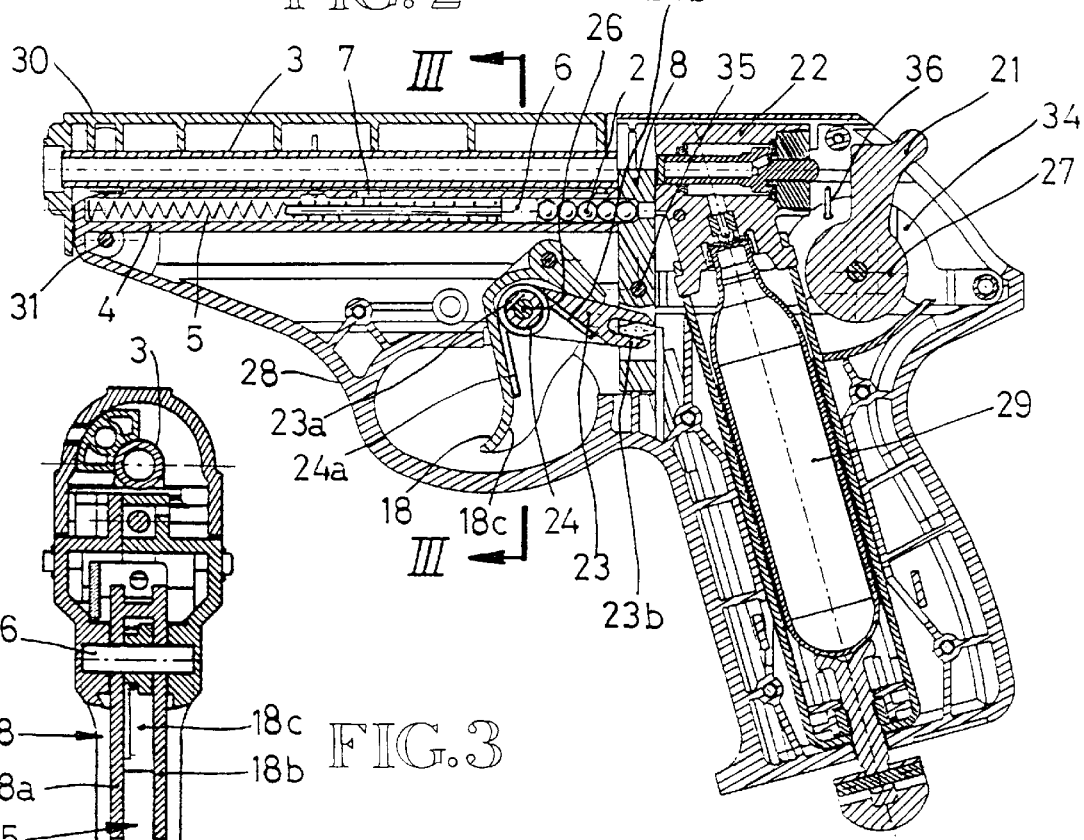
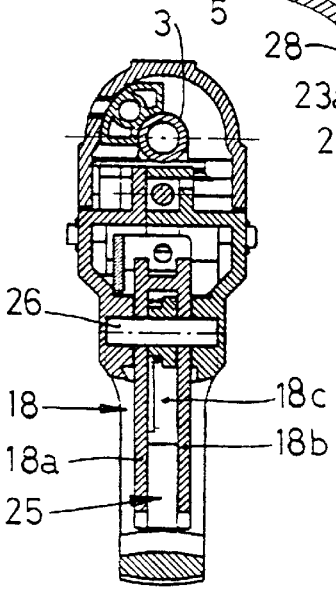
FIG. 3

FIG. 4
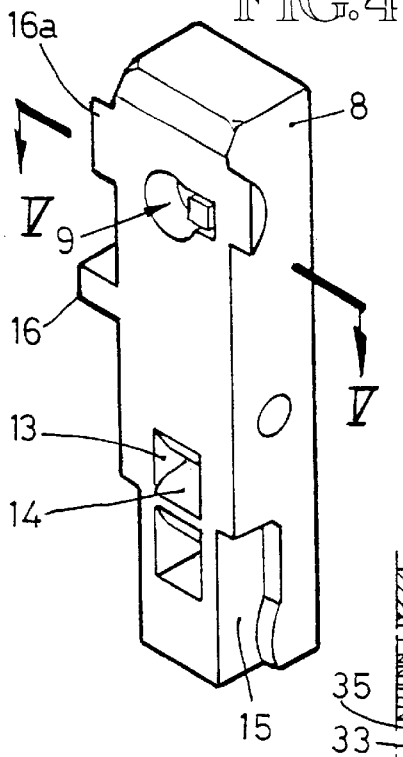
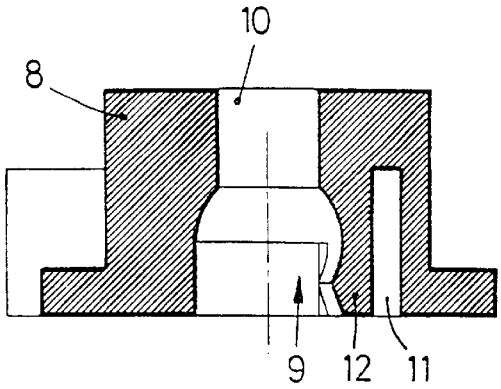
FIG. 5
FIG. 6
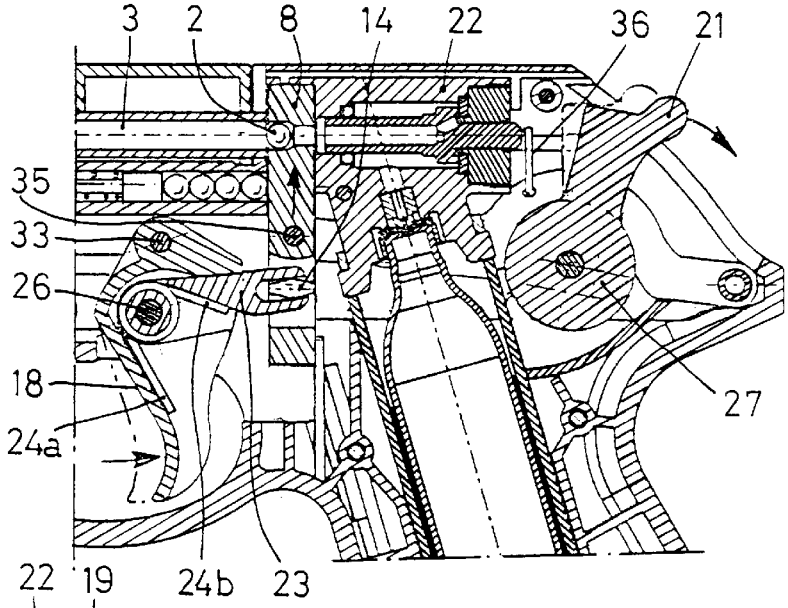
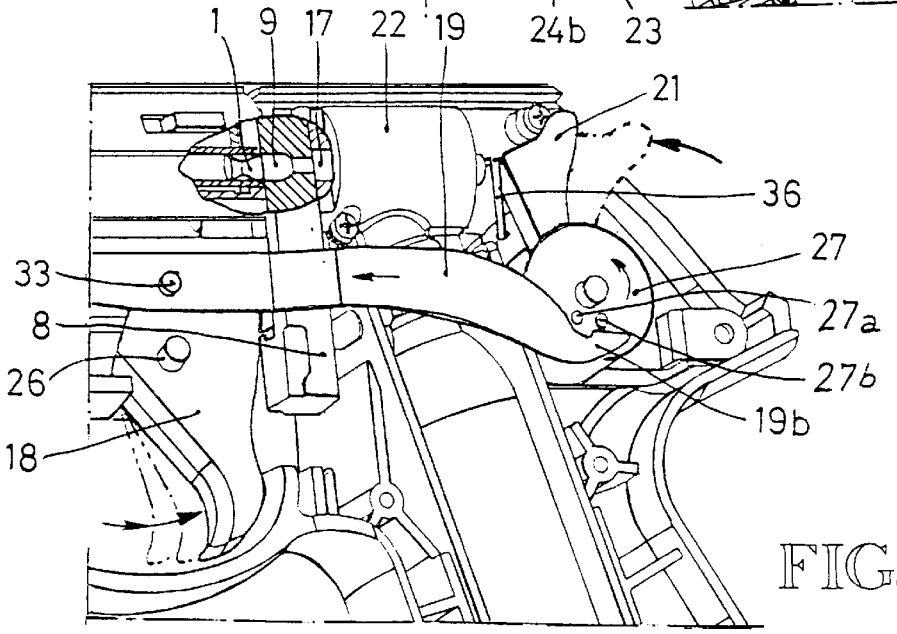
FIG. 7

FIG. 8
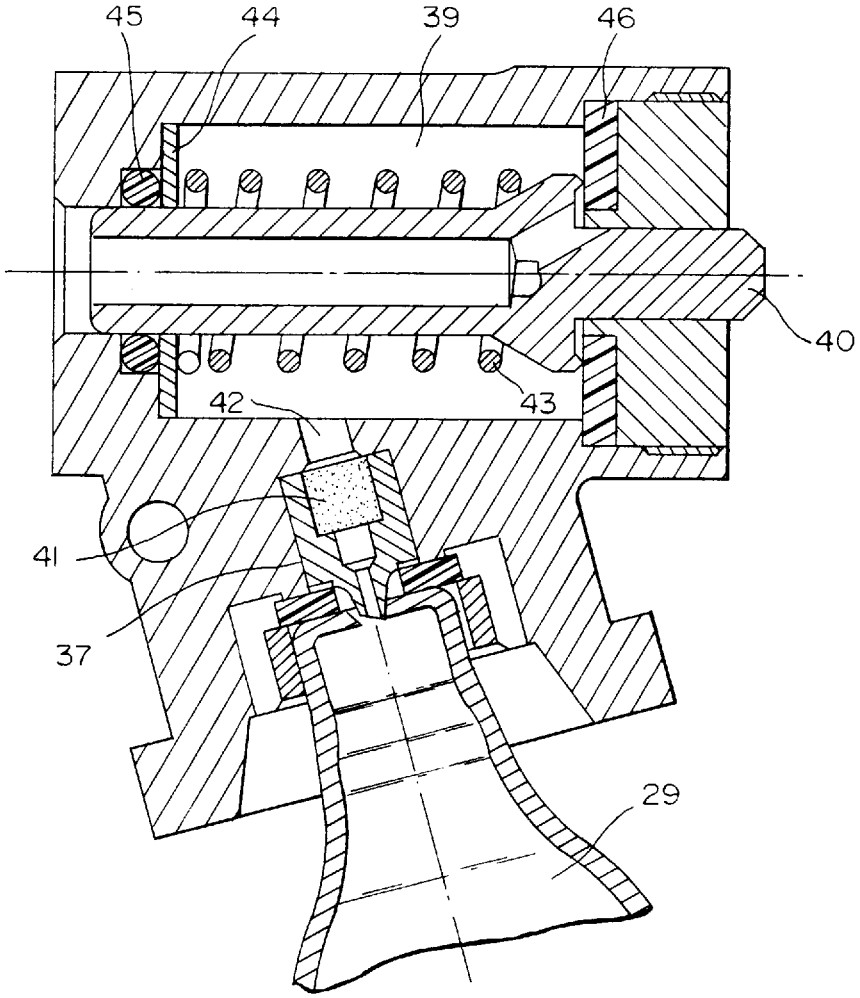
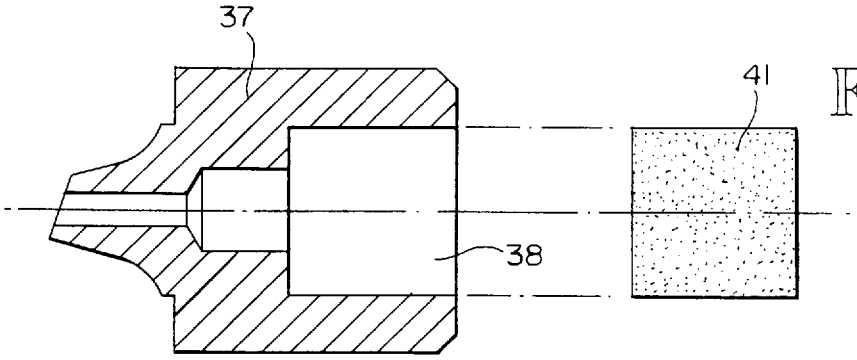
FIG. 9

DUAL MODE AMMUNITION LOADING AIR OR GAS-POWERED GUN

The present invention refers to a dual mode ammunition loading air or gas-powered gun, i.e. a gun conceived for shooting small bullets shot by shot, said small bullets being manually loaded into the barrel inlet, said barrel being tiltable for such a purpose, or for alternatively acting as a repeating weapon for shooting spherical ammunition (allowing to employ balls of several diameters: of lead, of iron with nickel coating of the "BB" type, etc.) fed from a loader. Said loader, known in itself, comprises a tubular magazine closed at one end on which rests a spring associated with a pusher provided with an appendage emerging through a longitudinal slot of said magazine and being apt to fit into a notch, said appendage allowing to shift said pusher thereby compressing the spring and allowing to load several spherical projectiles into the magazine, said spherical projectiles being after the release of the pusher dispensed one by one through the opposed end of the magazine into an ammunition shifting body which is mounted in a sliding arrangement at right angles with the barrel and is provided with a pocket apt to receive one only projectile from the loader and to shift it up to a position in coalignment with the barrel and the compresed-air/gas delivery hole.

As regards publications of prior art can be cited utility model no. 290417 relative to a projectile feeding device for gas-powered rifles, and patent no. 8702332 and utility model no. 8802566 also referring to ammunition feeding systems for rifles. In all cases the shifting of an ammunition shifting body has been foreseen by way of a slide at right angles to the barrel, said shifting being carried out by means of parts linked to the tilting portion of the barrel or through a specific auxiliary lever.

These publications of prior art do generally entail a complex and costly execution of the mechanism for shifting said shifting body, and their application to a gun would besides determine a bulky assembly.

Patent of invention no. 551101 describes in its turn a projectile loading system for air or gas-powered guns which comprises an external magazine like the above-mentioned one which is laterally fixed to the barrel, and a swinging carrier body apt to come into alignment with the outlet of the magazine and with the bore of the barrel.

The structure of the gun loading mechanism of this latter publication of prior art does also imply a bulky assembly, and because of the fact that the carrier body moves along an arcuate path the accuracy with which the ammunition receiving pocket can be aligned with the barrel is less than that obtainable with bodies acting by way of a linear slide at right angles with the barrel.

These publications of prior art do neither foresee the possibility of using diverse spherical ammunition with somewhat different diameters.

The gun as per the invention comprises a fixed loader of the above-mentioned type which is arranged inside the weapon and is accessible for reloading the latter with ammunition once the gun has been opened by tilting the barrel which is pin-jointed at its front end, the gun being provided with an ammunition shifting body that is structured by way of a perfectly guided slide actuated by means of the trigger with the interposition of a spring member. By means of such a structure said trigger, which is also linked as per a basic structure with a drawing member for the cocking and ulterior release of the striking hammer and for the positioning of an element assuring the proper actuation of said hammer (safety catch to prevent an accidental firing of the gun in case of its falling), makes it possible that along a first length of its travel the trigger positions the ammunition in shooting position by shifting said shifting body, the trigger being thereupon apt to travel an additional short length to release the cocked hammer. A highly compact and safely operating assembly is thus obtained.

The invention will be hereinafter described in detail with reference to drawings showing a practical embodiment cited only by way of an illustrative and nonlimiting example.

In said drawings:

FIG. 1 is a lateral perspective view of the gun which is partially open to show its main components.

FIG. 2 is a sectional side view of the gun acting as a repeating weapon for shooting spherical ammunition, with the trigger in rest position.

FIG. 3 is a cross-section along section line III—III in FIG. 2.

FIG. 4 is a perspective view at an enlarged scale of the ammunition shifting body.

FIG. 5 is an enlarged section along section line V—V in FIG. 4.

FIG. 6 is a partial side elevation of the sectioned gun similar to that of FIG. 2 but with the trigger in a first actuation position.

FIG. 7 is a partial lateral perspective view similar to that of FIG. 1 but with the trigger in a second actuation position, this latter case illustrating the use of a hand-loaded small bullet by way of ammunition.

FIG. 8 is a side elevation vie showing an arrangement of a filter block between a compressed-air/gas reservoir and a compression air/gas distribution chamber.

FIG. 9 is a side enlarged view illustrating how this filter block is housed inside a reservoir perforating element.

In said drawings it can be seen that the air or gas-powered gun in question is apt for dual mode ammunition loading thus allowing the shooting of small bullets (1) shot by shot, said small bullets being manually loaded into the inlet of a tiltable barrel (3) (FIG. 7), or its use as a repeating weapon for shooting spherical ammunition (2). In this latter case a projectile loader (4) has been provided which is fixed, is arranged internally in the weapon, and as can be seen is situated longitudinally underneath the position occupied by the barrel (3) in shooting position and parallel to the latter. Said loader (4), of conventional structure, consists in a magazine in the shape of a tube closed at one end on which rests a spring (5) associated with a pusher (6) provided with an appendage emerging through a longitudinal slot for the purpose of compressing the spring and allowing to introduce several spherical projectiles (2) through a hole (7) (FIG. 2) after having raised barrel (3), in such a way that after the release of pusher (6) said spherical projectiles are dispensed one by one through the open end of the tube into an ammunition shifting body (8) which is mounted in a sliding arrangement at right angles with barrel (3) and is provided with a pocket (9) apt to receive one only spherical projectile (2) from the loader (4) and to shift it up to a position in coalignment with barrel (3) and compressed-air/gas delivery hole (17).

The invention is characterized in that said shifting body (8) is linked for the purpose of its shifting with trigger (18) of the gun, in such a way that said trigger (18), besides being pin-jointed with an intermediate point (33) of a drawing member (19) which is spring-loaded at one **(19*a*) of its ends and whose other end (19*b*) is connected to the striking hammer (21) for its cocking and ulterior release as per a structure know in itself, has now an associated lever (23) whose first end (23*a*) is rotatably pin-jointed with said trigger (18) and whose other end (23***b*) is also linked in a hinged connection with said shifting body (8), a spring member (24) having been provided on which said lever (23) rests and which is also abutting with a rear wall of trigger (18).

As shown by FIG. 3, said trigger (18) has an inner hollow defining a recess (25) delimited by two lateral walls (18*a*, 18*b*) joined by rear wall (18*c*) of the profile of trigger (18), across said lateral walls being arranged a pin (26) around which is hinged end (23*a*) of said lever (23) whose other end (23*b*) is also linked in a hinged connection with a member (14) formed integrally with the shifting body (8). As shown by FIGS. 3 and 6, said pin (26) serving for the hinged connection of lever (23) with trigger (18) includes in a coaxial arrangement a torsion spring (24) ending in two elongated limbs (24*a*, 24*b*) one (24*a*) of which abuts against rear wall (18*c*) of trigger (18) whereas the other one (24*b*) abuts against the lower part of said lever (23). Such an arrangement determines that when pulling the trigger (18) said lever, in abutment on limb (24*b*), shifts the spherical ammunition shifting body (8) till positioning said spherical ammunition (2) in front of the inlet of barrel (3), said shifting body (8) coming to a halt at an abutting position whereas said spring (24) allows trigger (18) to cover an ulterior travel thereby compressing spring (24) whose limbs (24*a*, 24*b*) are thus brought nearer to each other up to a point where striking hammer (21) is released by said drawing member (19). The mutual relationship between lever (23) and trigger (18) with the intercalation of said spring (24) does also determine that if for any reason there is an obstacle in the travel of shifting body (8) when firing no breakage of the parts occurs since said spring (24) will yield resiliently.

As shown by FIGS. 2 and 6, lever (23) comprises at one (23*a*) of its ends a through hole for a pin (26) for its hinged connection to trigger (18), and at its other end (23*b*) a fork-shaped end portion enclosing said member (14) formed by a cross member of a through opening (13) of the ammunition shifting body (8), said opening being split in two by said cross member. The cross member has in this case a configuration with both ends having a triangular shape and with a central portion which is doubly convex in order to facilitate an adequate hinging at all points of relative motion between end (23*b*) and member (14). Spring (24) has been chosen such that its force constant allows to smoothly lift ammunition shifting body (8), and said spring will only yield when said body (8) has reached an abutting position.

In FIGS. 4 and 5 can be seen that ammunition receiving pocket (9) of shifting body (8) consists in a widened portion with a part-spherical contour continuing in a through hole (10) provided to come into alignment with the compressed-air/gas delivery passage, a slitting (11) having been provided around a wall (12) of said pocket (9), said wall being thus apt to resiliently yield thus acting by way of a clip so as to lightly hold inside said pocket spherical ammunition of several diameters such as lead balls or iron balls with nickel coating of the "BB" type or the like. In FIG. 4 can be seen as well recesses (15) and protuberances (16, 16*a*) of body (8) which have been provided in order to guarantee a perfectly guided shifting motion of said body as it moves by way of a slide in a housing provided for such a purpose in the weapon.

The drawings show as well several other parts of the gun which have a conventional structure, as per the following detail:

(27): cylindrical boss of hammer (21);

(27*a*, 27*b*): pins for linking boss (27) with rear end (19*b*) of drawing member (19);

(29): compressed-gas reservoir;

(30): barrel casing articulated at front pin (31) and releasable by means of catch (32);

(34): lever one of whose ends is pin-jointed at (35) to body (8) and which carries a member (36) allowing hammer (21) to actuate on the head of valve (22) thus opening the gas passage, said member (36) acting as a safety means.

(43): spring resting on a plate (44) coaxial to the valve member (40);

(45, 46) sealing joints of the compression air/gas distribution chamber (39).

FIGS. 8 and 9 illustrate the use of a filter (41) constituted by a porous block, for instance in polyethylene, in this embodiment housed inside a perforating element (37).

The use of a filter allows to restrain the passage of micro-particles which can be produced at the time of perforating the pressure air/gas reservoir (29), coming from the coating o the closure portion thereof and which while reaching the compression air/gas distribution chamber (39) can deteriorate the sealing joints (45, 46) and loose the air/gas tightness of said chamber.

The above description of the object of this patent being sufficient to enable those skilled in the art to put it into practice, it is claimed to extend said object to all those variations of detail which do not alter its essentiality, which is summarized in the following claims.

I claim:

1. A dual mode ammunition loading gas-powered gun, conceived for shooting small bullets shot by shot, said small bullets being manually loaded into a tiltable barrel inlet or for alternatively acting as a repeating weapon for shooting spherical ammunition comprising:

a tubular magazine closed at a first end on which rests a spring associated with a pusher provided with an appendage emerging through a longitudinal slot of said magazine, said appendage allowing to shift said pusher thereby compressing said spring and allowing to load several of said spherical ammunition into said tubular magazine, and after release of said pusher, said ammunition is dispensed one by one through a second opposed end of the magazine;

an ammunition shifting body mounted in a sliding arrangement at right angles with said barrel and provided with a pocket apt to receive one only spherical ammunition from said magazine and to shift it up to a position in coalignment with said barrel and with a compressed-gas delivery hole, communicating with a compressed-gas distribution chamber housing a valve member, wherein said shifting body is linked for the purpose of its shifting with a trigger of said gun, in such a way that said trigger, besides being pin-jointed with an intermediate point of a drawing member which is spring-loaded at one of its ends and whose other end is connected to the striking hammer for its cocking and ulterior release, is connected to an associated lever having a first end rotatably pin-jointed with said trigger and a second end linked in a hinged connection with said shifting body, a spring member having been provided on which said lever rests and which is also abutting with a rear wall of trigger.

2. A pistol as per the claim 1 wherein;

said trigger has an inner hollow defining a recess delimited by two lateral walls joined by rear wall, across said lateral walls being arranged a pin around which is hinged said first end of said lever whose cited second end is linked in a hinged connection with a member formed integrally with the shifting body;

said pin serving for the hinged connection of said lever with said trigger including in a coaxial arrangement a torsion spring ending in two elongated limbs one of which abuts against said rear wall of said trigger whereas a second one abuts against a lower part of said lever, so that when pulling said trigger said lever, in abutment on limb, shifts the spherical ammunition shifting body till positioning said spherical ammunition in front of an inlet of barrel; and said shifting body coming to a halt at an abutting position whereas said torsion spring allows said trigger to cover an ulterior travel thereby compressing said torsion spring up to a point where striking hammer is released by said drawing member.

3. A pistol, as per the claim 1, wherein:

said lever comprises at said first end a through hole for a pin for its hinged connection to said trigger, and at its other end a fork-shaped end portion enclosing a cross member of a through opening of said ammunition shifting body, said opening being split in two by said cross member.

4. A pistol, as per the claim 1, wherein:

said ammunition receiving pocket of said shifting body consists in a widened portion with a part-spherical contour continuing in a through hole provided to come into alignment with said compressed-air/gas delivery passage;

a slitting has been provided around a wall of said pocket, said wall being thus apt to resiliently yield thus acting by way of a clip so as to lightly hold inside said pocket spherical ammunition of a plurality of predetermined diameters.

5. A pistol, as per the claim 1, wherein:

it includes a compressed-gas reservoir having one of its ends facing a perforating element communicating through a hole with said compressed-gas distribution chamber lodging said valve member, and a filter block made of a porous material is located between the outlet of said reservoir and said chamber.

6. A pistol, as per the claim 1, wherein:

said porous filter block is in an abrasion resistive polymeric material, and said block is housed inside said perforating element.

* * * * *